US005305833A

United States Patent [19]

Collins

[11] Patent Number: 5,305,833

[45] Date of Patent: Apr. 26, 1994

[54] SHIFTING TOOL FOR SLIDING SLEEVE VALVES

[75] Inventor: Leo G. Collins, Lewisville, Tex.

[73] Assignee: Halliburton Company, Houston, Tex.

[21] Appl. No.: 17,788

[22] Filed: Feb. 16, 1993

[51] Int. Cl.[5] ..... E21B 34/00

[52] U.S. Cl. ..... 166/386

[58] Field of Search ..... 166/381, 386, 332-334, 166/319-322

[56] References Cited

U.S. PATENT DOCUMENTS

| | | | |
|---|---|---|---|
| 3,211,232 | 10/1965 | Grimmer | 166/194 |
| 3,552,718 | 1/1971 | Schwegman | 251/291 |
| 3,845,815 | 11/1974 | Garwood | 166/154 |
| 3,874,634 | 4/1975 | Gazda | 251/319 |
| 4,280,561 | 7/1981 | Fredd | 166/332 |
| 4,436,152 | 3/1984 | Fisher | 166/214 |
| 5,183,114 | 2/1993 | Mashaw, Jr. et al. | 166/332 X |
| 5,211,241 | 5/1993 | Mashaw, Jr. et al. | 166/332 |

OTHER PUBLICATIONS

Otis Product and Services Catalog, Subsurface Wireline Equipment-Positioning Tools, 1989, p. 268.

Otis Sales Brochure, Otis Sliding Side Door, Circulation/Production Device, 1985.

*Primary Examiner*—Thuy M. Bui

*Attorney, Agent, or Firm*—Tracy W. Druce; Monty L. Ross

[57] ABSTRACT

A shifting tool for sliding sleeve valves for use in oil and gas wells which has locating dogs that are used for selectively locating and engaging a shoulder inside the valve. Primary keys engage and selectively shift the sliding sleeve to an equalized position as well as prevent premature shifting to a fully open position. Also included is apparatus for selectively overriding the shifting prevention following equalization. Secondary keys lead the primary keys in the shifting direction and engage the sleeve and move it to the fully open detent position. There is also selective disengagement of the shifting tool from the sleeve valve to allow withdrawal of the shifting tool form the well. Furthermore, a method for selectively and sequentially shifting the sliding sleeve for a sliding sleeve valve from the closed to equalizing position, and then from the equalizing to fully open position is disclosed.

16 Claims, 5 Drawing Sheets

SHIFTING TOOL FOR SLIDING SLEEVE VALVES

BACKGROUND OF THE INVENTION

1. Field of the Invention

This invention relates to shifting tools for sliding sleeve type valves used in conduits or tubing strings in oil and gas wells, and more particularly, to a shifting tool adapted for selectively and sequentially shifting a sliding sleeve to intermediate and fully open positions, and for providing a positive indication to the operator as to the position of the shifter and sleeve.

2. Description of Related Art

Sliding sleeve valves for use in oil and gas valves are well known. Sliding sleeve valves are disclosed in the prior art, for example, in U.S. Pat. Nos. 3,211,232; 3,552,718; 3,845,815; 3,874,634; and 4,280,561. Some prior art shifting tools for sliding sleeve valves are disclosed in the foregoing patents, and also in U.S. Pat. No. 4,436,152.

Sliding sleeve valves can be used to control fluid flow between a tubing string and the surrounding annulus during circulation or production. Sliding sleeve valves typically contain an inner sleeve having a port that can be selectively shifted to either permit or block fluid flow through ports in the valve body. Seals are provided between the inside wall of the valve body and the sliding sleeve to prevent fluid bypass whenever the valve is closed. Sliding sleeve valves are available in configurations that either shift down to open and up to close, or up to open and down to close. The valves are ordinarily shifted using a shifting tool that is part of a wireline-deployed tool string.

In recent years, sliding sleeve valves have become available that have three distinct positions, with an equalizing position being disposed intermediate the open and closed positions. The bodies of these valves typically comprise at least one smaller diameter equalizing port through which the tubing pressure and annulus pressure can be balanced prior to fully opening the valve. By first shifting the sliding sleeve to the equalizing position, one reduces the likelihood of wireline failure due to a pressure surge as the valve is opened. When the three position sliding sleeve valves are used with the conventional shifting tools, however, operators have sometimes encountered difficulty in sequentially positioning the sliding sleeve in the intermediate, equalizing position. If the sliding sleeve is accidentally overshifted to the fully open position without first equalizing the pressure between the annulus and the interior of the tubing, damage to the valve, wireline or tool string can still occur.

A shifting tool is therefore needed that can be used to sequentially shift the sliding sleeve of a sliding sleeve valve to the equalizing and fully open positions and that will provide a positive indication to the operator whenever the sliding sleeve is in the equalizing or fully open position, respectively.

SUMMARY OF THE INVENTION

According to one embodiment of the invention, a shifting tool for sliding sleeve valves is provided that comprises means for locating the shifting tool inside a sliding sleeve valve deployed downhole in an oil or gas well; means for selectively engaging the sliding sleeve and for sequentially shifting the sliding sleeve from the closed position first to the partially open equalizing position, and then from the equalizing position to the fully open position; means for temporarily blocking the sliding sleeve to prevent accidental overshifting of the sliding sleeve past the equalizing position to the fully open position prior to equalization; and means for disengaging the shifting tool from the sliding sleeve valve after the shift is completed. The invention disclosed herein is preferred for use with sliding side door valves but is adaptable for use with other sliding sleeve valves as well. The present invention is also adaptable for use with sliding sleeve valves disposed in either a "shift up" or "shift down" position.

According to a preferred embodiment of the invention, a shifting tool for a sliding sleeve valve is provided that comprises a primary key means adapted to limit travel of the sliding sleeve at a position corresponding to the equalizing position of the valve, a secondary key means adapted to limit travel of the sliding sleeve at a position corresponding to the fully open position of the valve, a first shearable means controlling retraction of the primary key means, and a second shearable means controlling retraction of the secondary key means. Both the first and second shearable means are preferably adapted to be sheared by pressuring the shifting tool in the direction of shift from the closed to the open position. The primary and secondary key means are preferably radially expandable and outwardly biased. The primary key means, which engages the sliding sleeve of a sliding sleeve valve to shift it from the closed to the equalizing position, preferably comprises a first square shoulder adapted to abut an opposing square shoulder in the sliding sleeve. A second square shoulder on the primary key means is adapted to abut an opposing square shoulder in the inside wall of the outer sub of the sliding sleeve valve when the sliding sleeve has been shifted to the equalizing position, thereby preventing accidental overshifting to the fully open position. The secondary key means preferably comprises a square shoulder adapted to abut an opposing square shoulder in the sliding sleeve.

According to another preferred embodiment of the invention, a shifting tool is provided that comprises a plurality of radially expandable primary keys each having a first square shoulder adapted to engage an abutting shoulder in the sliding sleeve and a second square shoulder adapted to engage an abutting shoulder in the valve body to prevent overtravel of the shifting sleeve when it is being shifted to the equalizing position. The preferred shifting tool further comprises a primary shear pin that is sheared while pressuring the shifting tool in the shift direction after pressure has equalized between the tubing and annulus. Means are also preferably provided for simultaneously retracting the primary keys and for releasing a plurality of radially expandable secondary keys for engagement with the sliding sleeve for use in shifting the sliding sleeve to the fully open position. A secondary shear pin is preferably provided that can be sheared after the valve is fully open to permit retraction of the secondary keys.

According to another embodiment of the invention, a method for shifting a sliding sleeve valve in an oil or gas well is provided that comprises the steps of locating a shifting tool comprising radially expandable primary and secondary key means inside the closed sliding sleeve valve; expanding the primary key means to engage the sliding sleeve; shifting the sliding sleeve to the equalizing detent position and simultaneously blocking the sliding sleeve from shifting to the fully open detent position; retracting the primary key means from engagement with the sliding sleeve; expanding the secondary key means to engage the sliding sleeve; shifting the sliding sleeve to the fully open detent position; and thereafter retracting the secondary key means from engagement with the sliding sleeve.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 1:
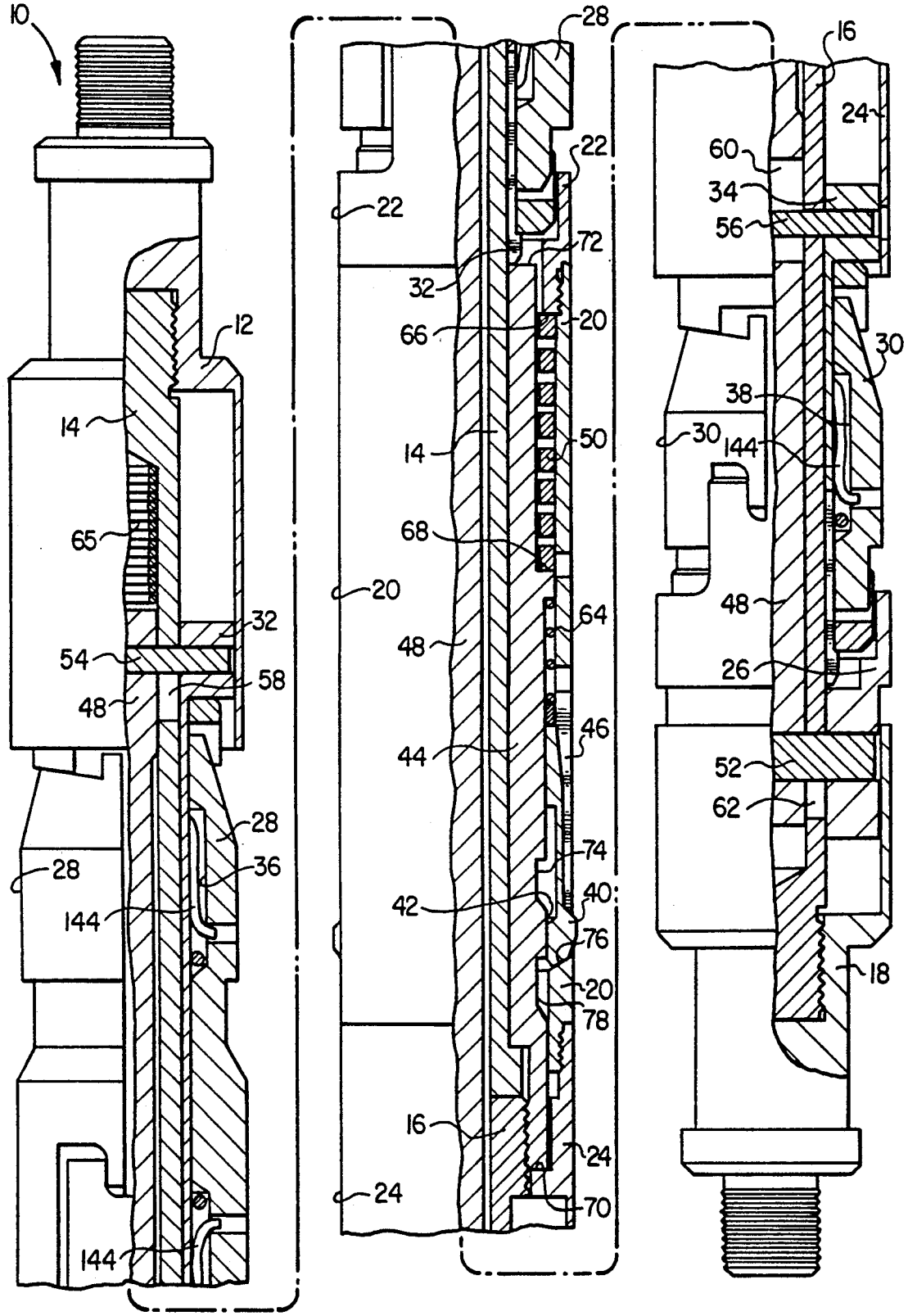
FIG. 1 is an elevation view, partially in section, depicting the shifting tool of the invention in the running configuration.

FIG. 1 depicts a preferred embodiment of shifting tool 10 of the invention in the running position in a shift down configuration, although it will be apparent to those of ordinary skill in the art upon reading this disclosure that the apparatus and method disclosed herein can be similarly utilized in a shift up configuration. Referring to FIG. 1, shifting tool 10 preferably comprises top sub 12 and bottom sub 18, which are maintained in spaced apart relation by abutting upper mandrel 14 and lower mandrel 16. Locator sleeve 20 is disposed around upper mandrel 14 and confines primary key release spring 50 and spring guide 44 therebetween. The lower end of spring guide 44 is in threaded engagement with lower mandrel 16. Radially expandable primary keys 28 are disposed between top sub 12 and upper retainer ring 22, which is threaded into the top end of locator sleeve 20. Radially expandable secondary keys 30 are disposed between lower sleeve 24 and lower retainer ring 26, which is slidably disposed inside bottom sub 18. Recesses 36, 38, are provided in primary keys 28 and secondary keys 30, respectively, to accommodate conventional means such as springs 144 (sometimes referred to as grasshopper springs or butterfly springs) for biasing the keys radially outward.

When shifting tool 10 is in its running position as shown in FIG. 1, primary keys 28 and secondary keys 30 are held in their unexpanded positions against upper and lower support sleeves 32, 34 by upper and lower retainer rings 22, 26, respectively. Inner mandrel 48 is maintained in fixed relation to lower retainer ring 26 by pin 52 and in fixed relation to upper support sleeve 32 by primary shear pin 54. Lower mandrel 16 is similarly maintained in fixed relation to lower support sleeve 34 by secondary shear pin 56. Slot 58 in upper mandrel 14 permits limited longitudinal movement of inner mandrel 48 relative to upper mandrel 14 around primary shear pin 54. Slot 60 permits limited longitudinal movement of inner mandrel 48 relative to lower mandrel 16 around secondary shear pin 56. Slot 62 permits limited longitudinal movement of inner mandrel 48, pin 52 and lower retainer ring 26 relative to lwoer mandrel 16. In the running position, primary key release spring 50 forces shoulder 66 of upper retainer ring 22 upward relative to shoulder 68 of spring guide 44 until shoulder 70 of lower sleeve 24, which is threaded onto the lower end of locator sleeve 20, abuts against the lower end of spring guide 44. When upper retainer ring 22 is in its uppermost position as shown in FIG. 1, primary keys 28 are prevented from expanding radially outward. Lower retainer ring 26 likewise prevents secondary keys 30 from expanding because it is pinned by pin 52 in fixed relation to inner mandrel 48, which is pinned by primary shear pin 54 to upper support sleeve 32. Upper support sleeve 32 is prevented from traveling downward because its bottom edge abuts upwardly facing shoulder 72 of spring guide 44.

As shifting tool 10 is run into a well conduit containing a sliding sleeve valve, typically as part of a wireline tool string, circumferentially spaced locating dogs 40 are supported by land 42 of spring guide 44 in a position where they extend radially outward through window 46 of locator sleeve 20. Locator spring 64 prevents locating dogs 40 from sliding upward into recess 74 of spring guide 44. Shifting tool 10 is run past the profile of the sliding sleeve to be shifted and then pulled back up to the point where locating dogs 40 engage a shoulder on the bottom of the packing mandrel (not shown) of the sliding sleeve valve. Once locating dogs 40 engage the packing mandrel, primary keys 28 are engaged by pulling up on the wireline.

Figure 2:
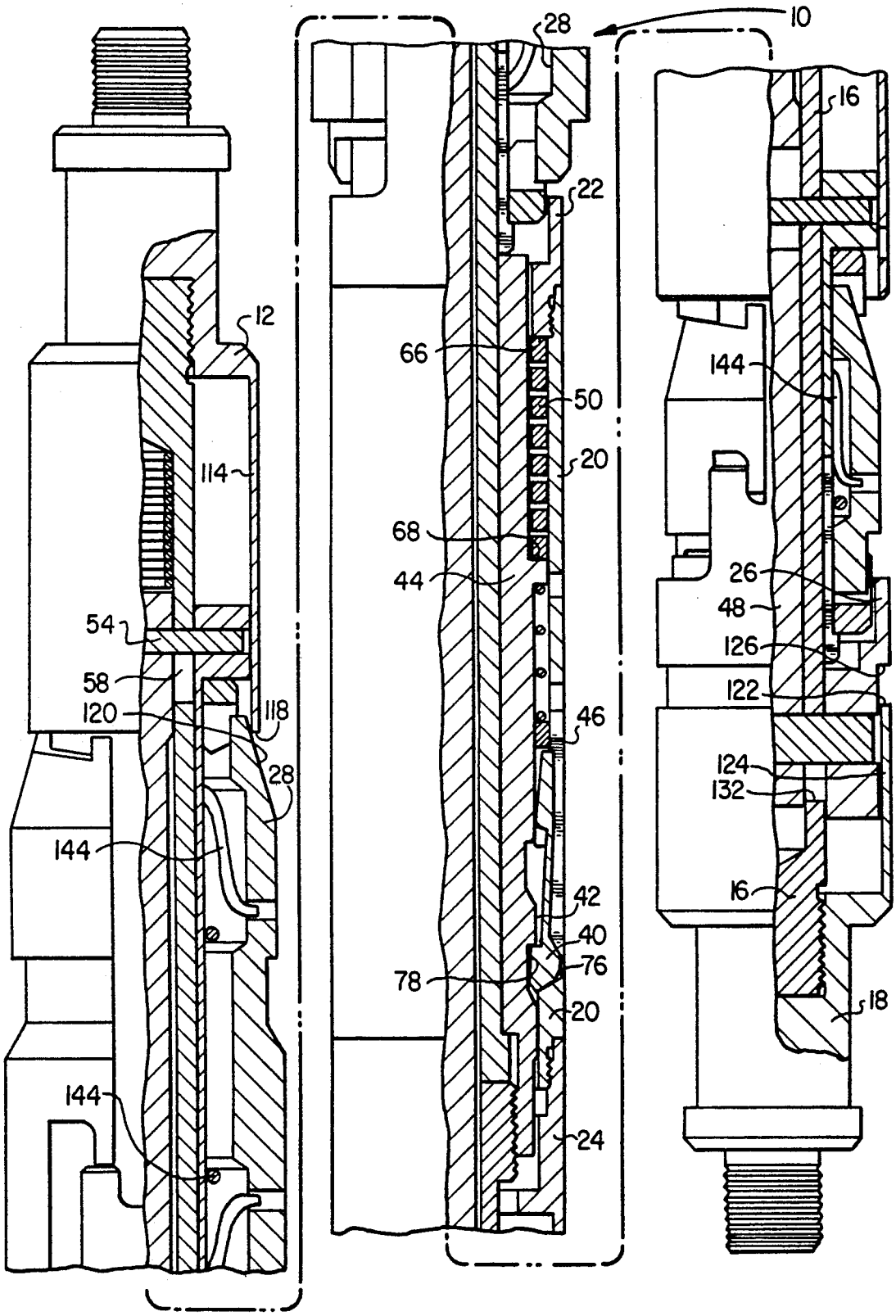
FIG. 2 is an elevation view, partially in section, depicting the shifting tool of the invention in the position where the primary equalizing keys are released.

In FIG. 2, shifting tool 10 is shown in the configuration that exists after an upwardly directed force has been exerted on top sub 12 to release primary keys 28. Referring to FIG. 2, as top sub 12 is pulled upward from the position shown in FIG. 1, locating dogs 40 slide downward along spring guide 44. This simultaneously forces locator sleeve 20 downward relative to spring guide 44 because locating dogs 40 abut shoulder 76 at the bottom of window 46 of locator sleeve 20. As locator sleeve 20 moves downward relative to spring guide 44 a sufficient distance, locating dogs 40 fall off land 42 and drop into annular recess 78. Primary key release spring 50 is compressed between shoulders 66 and 68, and maintains upward tension on locator sleeve 20 relative to spring guide 44. The distance that locator sleeve 20 travels before locating dogs 40 retract into recess 78 is such that upper retainer ring 22 on locator sleeve 20 is pulled down sufficiently to release primary keys 28 to expand radially into contact with the sliding sleeve of the valve.

Figures 5A, 5B, 5C, 6A, 6B, 6C:
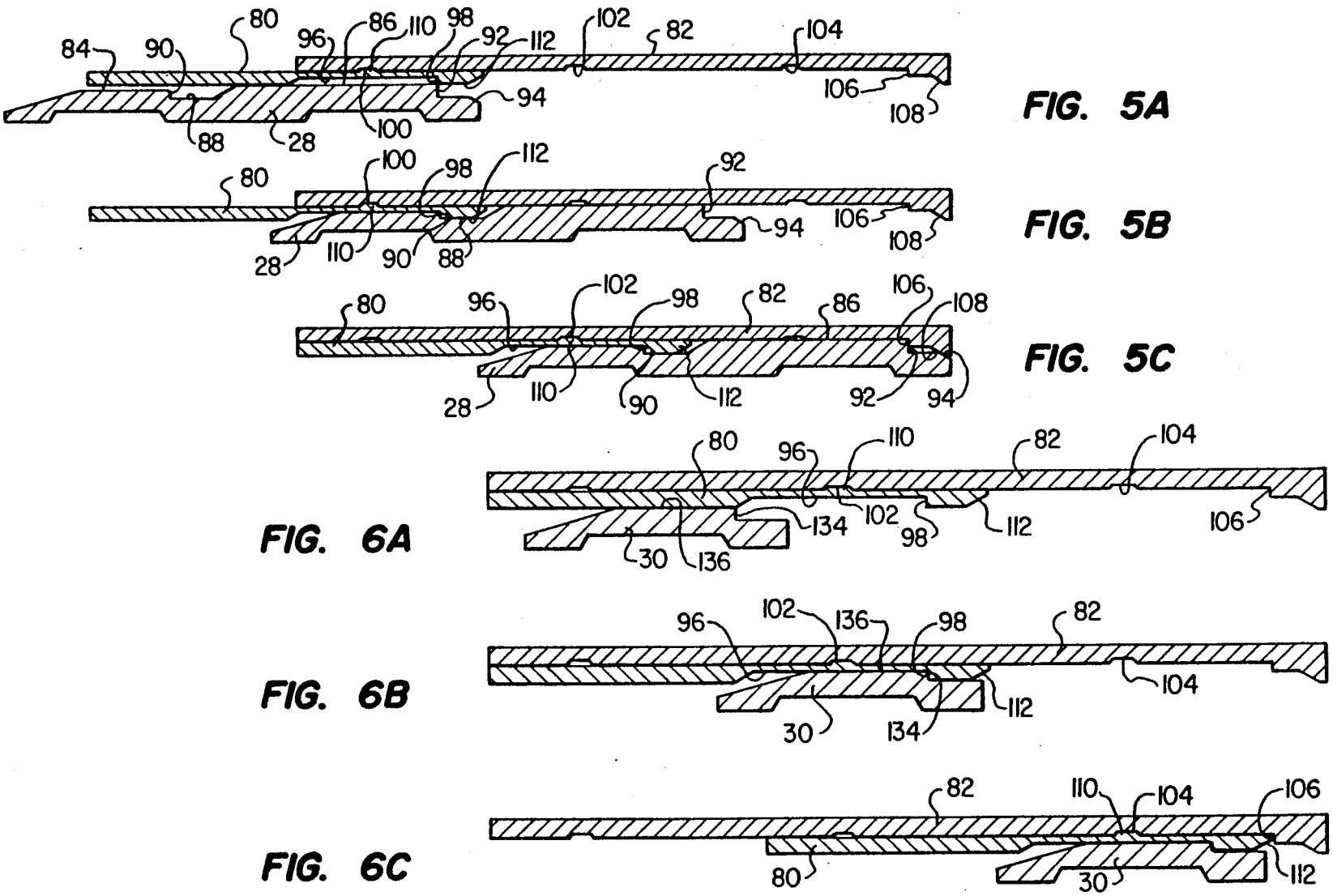
FIG. 5 is a simplified sectional schematic view consisting of FIGS. 5A, 5B and 5C depicting a primary key in relation to the sliding sleeve and the outer sub of a sliding sleeve valve in the disengaged closed position, in the engaged closed position, and in the engaged equalizing positions, respectively.
FIG. 6 is a simplified sectional schematic view consisting of FIGS. 6A, 6B and 6C depicting a secondary key in relation to the sliding sleeve and the outer sub of a sliding sleeve valve in the disengaged equalizing position, in the engaged equalizing position, and in the engaged fully open position, respectively.

FIG. 5A is a schematic view depicting a primary key 28 in relation to a portion of sliding sleeve 80 and outer sub 82 of a sliding sleeve valve. Referring to FIG. 5A, primary key 28 comprises a profile having longitudinally spaced lands 84, 86 separated by recess 88. Sliding sleeve 80 has a recess 96 having a configuration adapted to receive land 84 of primary key 28 whenever they are brought into cooperative alignment. Lip 112 of sliding sleeve 80 is likewise configured to mate with recess 88 of primary key 28. Sliding sleeve 80 comprises square shoulder 98 adapted to abut against square shoulder 90 of primary key 28 whenever land 84 is engaged in recess 96. Outer sub 82 comprises detents 100, 102 and 104 corresponding respectively to the closed, equalizing and fully open positions of the sliding sleeve valve. As shown in FIG. 5A, projection 110 on sliding sleeve 80 is engaged in detent 100 of outer sub 82, corresponding to the fully closed valve position.

Referring to FIG. 2 in combination with FIG. 5B, after primary keys 28 of shifting tool 10 are released and locating dogs 40 are retracted into window 46, shifting tool 10 is pressured downward until land 84 slides downward into engagement with recess 96 and lip 112 drops into recess 88 as shown in FIG. 5B. Because square shoulders 90, 98 are then in abutting contact, continued downward pressure exerted on top sub 12 will cause primary keys 28 to disengage projection 110 of sliding sleeve 80 from detent 100 of outer sub 82, and shift sliding sleeve 80 downward until projection 110 engages detent 102, corresponding to the equalizing position of the valve, as shown in FIG. 5C.

Referring to FIG. 5C, land 86 of primary key 28 slides along outer sub 82 until square shoulder 92 contacts square shoulder 106 and shoulder 94 abuts against shoulder 108. Because shoulders 92, 94 and 106, 108 cooperate respectively to block further travel of primary key 28 relative to outer sub 82 for so long as land 86 is in sliding engagement with outer sub 82, primary key 28 is prevented from overshifting sliding sleeve 80 beyond the equalizing position of the sliding sleeve valve.

Figure 3:
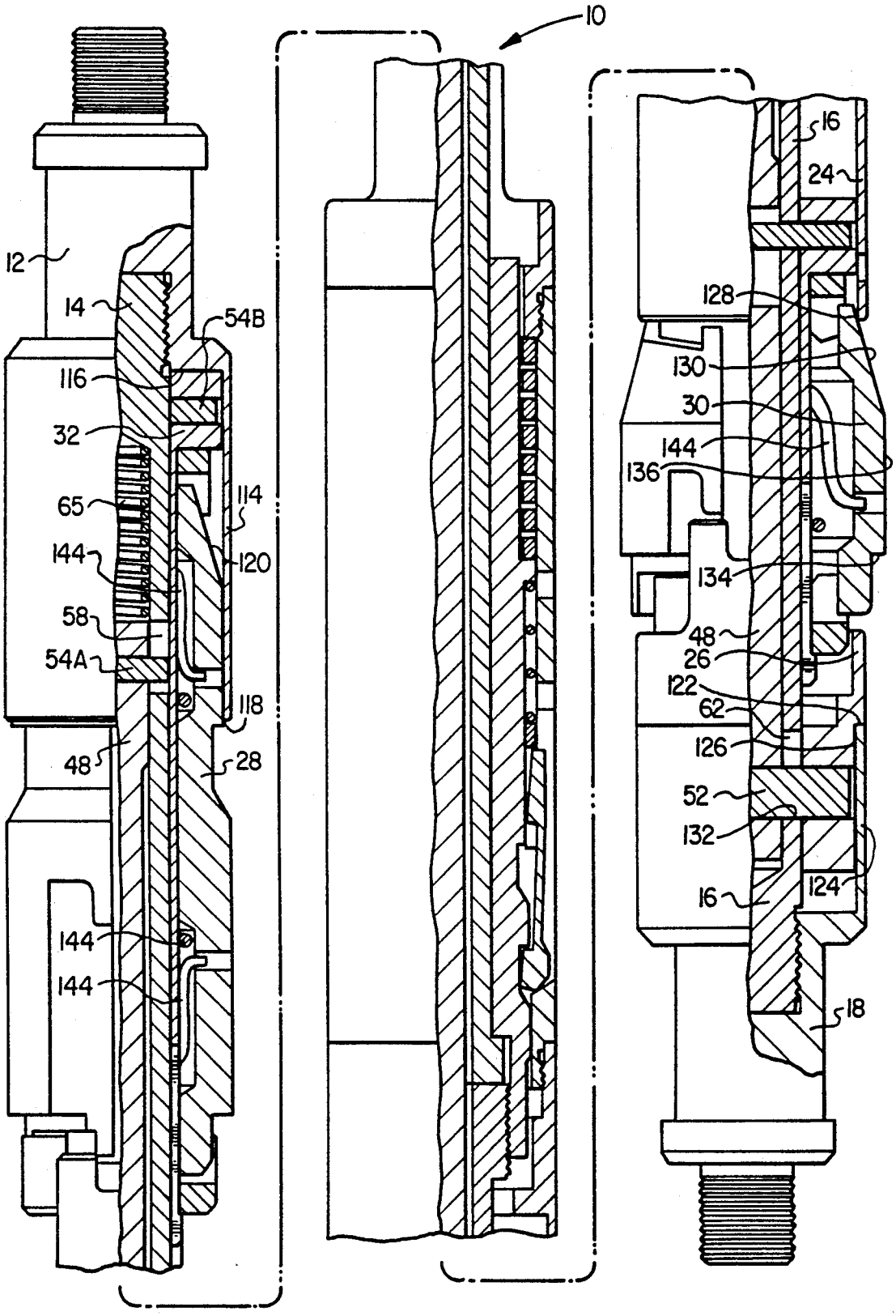
FIG. 3 is an elevation view, partially in section, depicting the shifting tool of the invention in the position where the primary shear means is sheared, the primary keys are retracted, and the secondary keys are expanded.

Referring to FIGS. 2 and 5C, whenever primary keys 28 are fully expanded, inclined surface 120 of primary key 28 remains slightly beneath lower edge 118 of skirt 114 of top sub 12. Once the pressures inside and outside the valve have equalized, primary keys 28 are retracted from sliding sleeve 80 by exerting sufficient downward force on top sub 12, such as by jarring down, to shear primary shear pin 54 into portions 54A and 54B, as shown in FIG. 3. As primary shear pin 54 shears while pressuring shifting tool 10 downward, lower edge 118 of skirt 114 of top sub 12 slides downward relative to inclined surface 120 of primary keys 28, causing primary keys 28 to be retracted. Upper support sleeve 32 simultaneously slides upward relative to top sub 12 and upper mandrel 14 until upper support sleeve 32 contacts wall 116. In this position, as shown in FIG. 3, primary keys 28 are retained in the retracted position by skirt 114 of top sub 12. The shearing of shear pin 54 also permits inner mandrel spring 65 to force inner mandrel 48 downward relative to upper mandrel 14 and lower mandrel 16 until pin 52 slides downward in slot 62 to the point where pin 52 contacts wall 132 of lower mandrel 16. As pin 52 is carried downward in slot 62 by inner mandrel 48, it simultaneously causes lower retainer ring 26 to slide downward relative to bottom sub 18 until shoulder 126 (seen in FIG. 2) of lower retainer ring 26 abuts against top edge 122 of skirt 124 of bottom sub 18. As lower retainer ring 26 moves downward relative to secondary keys 30, secondary keys 30 are released to expand radially outward by the biasing action of conventional springs 144. An important feature of the primary and secondary key configuration disclosed for use with the present invention is that secondary keys 30 are leading rather than trailing primary keys 28 in the shift direction. This will ensure that secondary keys 30 cannot inadvertently shift the sleeve when primary pin 54 is sheared.

In FIG. 6A, sliding sleeve 80 is shown in the equalizing position in which projection 110 is engaged in detent 102 of outer sub 82, which corresponds to the positions of sliding sleeve 80 and outer sub 82 in FIG. 5C. Referring to FIGS. 3 and 6A, after secondary keys 30 have expanded, shifting tool 10 is desirably lifted until shoulder 134 of secondary keys 30 is above recess 96 of sliding sleeve 80. Shifting tool 10 is then lowered, and land 136 of secondary keys 30 expands into engagement with recess 96 of sliding sleeve 80 as shown in FIG. 6B. As secondary keys 30 slide downward relative to sliding sleeve 80, square shoulder 134 of secondary keys 30 abuts square shoulder 98 of lip 112 of sliding sleeve 80. Continued downward pressure exerted on secondary keys 30 through shifting tool 10 causes projection 110 to disengage from detent 102 of outer sub 82, and sliding sleeve 80 is shifted downward to the fully open position in which projection 110 engages detent 104. Further downward travel of sliding sleeve 80 is limited by lip 112 of sliding sleeve 80 contacting square shoulder 106 of outer sub 82.

Figure 4:
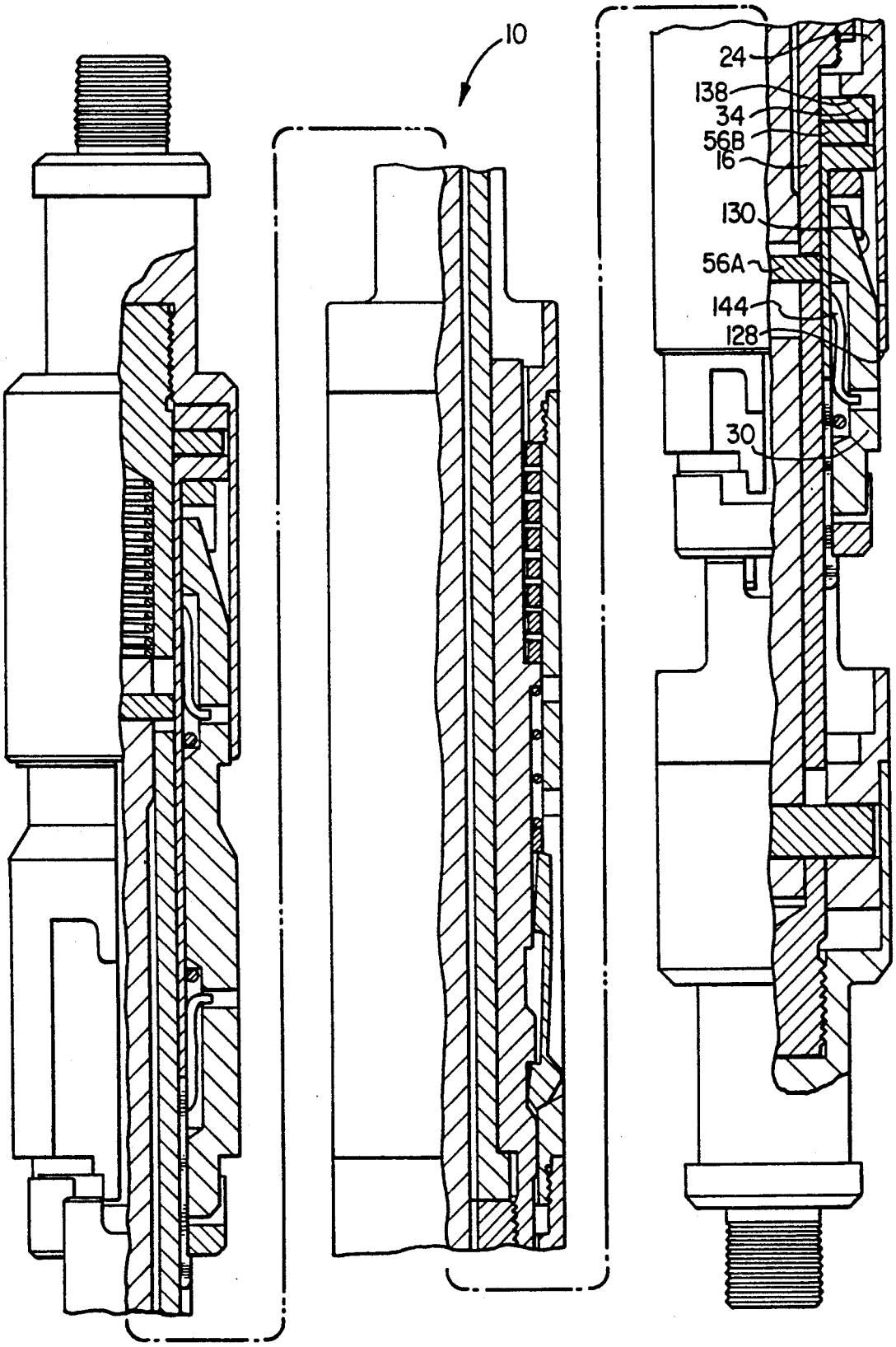
FIG. 4 is an elevation view, partially in section, depicting the shifting tool of the invention in the position where the secondary shear means is sheared and the secondary keys are retracted, disengaging the shifting tool from the sliding sleeve valve.

After secondary keys 30 have shifted sliding sleeve 80 to the detent position corresponding to the fully open position of the sliding sleeve valve, they can be selectively disengaged from sliding sleeve 80 by jarring down on shifting tool 10 sufficiently to shear secondary shear pin 56 as shown in FIG. 4. Referring to FIG. 4, when secondary shear pin 56 is sheared into portions 56A and 56B, lower support sleeve 34 slides upward relative to lower mandrel 16 and lower sleeve 24 until lower support sleeve 34 contacts shoulder 138. Because, as seen in FIG. 3, a portion of inclined surface 130 of secondary keys 30 remains radially inward of lower edge 128 of lower sleeve 24 when secondary keys 30 are fully expanded, secondary keys 30 are retracted against the spring bias as lower sleeve 24 moves downward. Once shifting tool 10 has been placed in the configuration shown in FIG. 4, it can be removed from the sliding sleeve valve and either withdrawn or lowered further into the well as part of the tool string. The operator can be assured that all keys of shifting tool 10 have released if shifting tool 10 can be raised and lowered through the profile.

Testing of the apparatus of the invention has demonstrated that the performance of the subject invention can be improved by hardening all shearing surfaces to prevent deformation, by hardening surfaces that contact the keys (especially during retraction) to reduce the possibility of damage, and by pinning threaded mandrel connections to prevent threads from backing off. Whenever the apparatus of the invention is used in a "shift up" as opposed to "shift down" configuration, means should also desirably be provided to support the tool weight when shifting up.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

I claim:

1. A shifting tool for use with a sliding sleeve valve deployed in an oil or gas well, the sliding sleeve valve being characterized by a tubular body, at least one port providing fluid communication through the body, a longitudinally slidable sleeve disposed inside the body for selectively controlling fluid flow through the port, and detent positions marking the locations of closed, equalizing and fully open positions of the sliding sleeve relative to the port, the shifting tool comprising:

means for selectively locating and engaging a predetermined profile inside the valve;

means for engaging and selectively shifting the sliding sleeve to the equalizing detent position;

means for preventing premature shifting of the sliding sleeve to the fully open detent position;

means for selectively overriding the preventing means following equalization of pressure across the port;

means for engaging and selectively shifting the sliding sleeve to the fully open detent position; and means for selectively disengaging the shifting tool from the sliding sleeve valve for withdrawal of the shifting tool from the well;

the means for engaging and selectively shifting the sliding sleeve to the fully open detent position being disposed in a leading position relative to the means for engaging and selectively shifting the sliding sleeve to the equalizing detent position.

2. The shifting tool of claim 1 wherein the means for engaging and selectively shifting the sliding sleeve to the equalizing detent position is radially expandable, outwardly biased primary key means further comprising first shoulder means for engaging and abutting an opposing shoulder in the sliding sleeve.

3. The shifting tool of claim 2 wherein the primary key means further comprises the means for preventing premature shifting of the sliding sleeve to the fully open detent position.

4. The shifting tool of claim 3 wherein the means for preventing premature shifting of the sliding sleeve to the fully open detent position is second shoulder means longitudinally spaced apart from the first shoulder means on the primary key means.

5. The shifting tool of claim 2 wherein the means for selectively overriding the preventing means following equalization of pressure across the port comprises a primary shear pin.

6. The shifting tool of claim 2 wherein the means for selectively overriding the preventing means following equalization of pressure across the port comprises means for retracting the primary key means.

7. The shifting tool of claim 1 wherein the means for engaging and selectively shifting the sliding sleeve to the fully open detent position is a radially expandable, outwardly baised secondary key means further comprising shoulder means for engaging and abutting an opposing shoulder in the sliding sleeve.

8. The shifting tool of claim 1 wherein the means for selectively disengaging the shifting tool from the sliding sleeve valve for withdrawal of the shifting tool from the well comprises a secondary shear pin.

9. The shifting tool of claim 7 wherein the means for selectively disengaging the shifting tool from the sliding sleeve valve for withdrawal of the shifting tool from the well comprises means for retracting the secondary key means.

10. In a shifting tool for a sliding sleeve valve deployed in an oil and gas well, the sliding sleeve valve being characterized by a tubular body, at least one port providing fluid communication through the body, a longitudinally slidable sleeve disposed inside the body for selectively controlling fluid flow through the port, and detent positions marking the locations of closed, equalizing and fully open positions of the sliding sleeve relative to the port, the improvement comprising retractable means for engaging and longitudinally shifting the sliding sleeve from the closed position to the equalizing detent position and retractable means for simultaneously blocking further longitudinal movement of the sliding sleeve between the equalizing detent position and the fully open detent position.

11. A tool for sequentially and selectively shifting the sliding sleeve of a sliding sleeve valve of the type used in oil and gas wells from a closed position to a partially open equalizing position, and from a partially open equalizing position to a fully open position, the shifting tool comprising:

first radially expandable means for selectively engaging the sliding sleeve and for communicating force from the shifting tool to the sliding sleeve to shift the sliding sleeve from the closed position to the equalizing position, said means further comprising means for preventing overshifting of the sliding sleeve from the equalizing position to the fully open position while said first radially expandable means is in engagement with the sliding sleeve;

means for selectively retracting the first radially expandable means after the sliding sleeve is shifted to the equalizing position;

second radially expandable means operable for selectively engaging the sliding sleeve only after retraction of the first radially expandable means and for thereafter communicating force from the shifting tool to the sliding sleeve to shift the sliding sleeve from the equalizing position to the fully open position; and means for selectively retracting the second radially expandable means after the sliding sleeve is shifted to the fully open position.

12. The tool of claim 11 wherein the first radially expandable means comprises an outwardly biased key having a profile further comprising longitudinally spaced first and second square shoulders defining radially extending bearing surfaces facing in the direction toward which the sliding sleeve is shifted to open the sliding sleeve valve.

13. The tool of claim 11 wherein the second radially expandable means comprises an outwardly biased key having a profile further comprising a square shoulder defining a radially extending bearing surface facing in the direction toward which the sliding sleeve is shifted to open the sliding sleeve valve.

14. The tool of claim 11 wherein the means for selectively retracting the first radially expandable means after the sliding sleeve is shifted to the equalizing position comprises a primary shearable means that is rated to withstand a shear force greater than that required to shift the sliding sleeve from the closed position to the equalizing position.

15. A method for opening a closed sliding sleeve valve deployed in an oil and gas well, the sliding sleeve valve being characterized by a tubular body, at least one port providing fluid communication through the body, a longitudinally slidable sleeve disposed inside the body for selectively controlling fluid flow through the port, and detent positions marking the locations of closed, equalizing and fully open positions of the sliding sleeve relative to the port, the method comprising the steps of:

a. locating a shifting tool comprising radially expandable primary and secondary key means inside the closed sliding sleeve valve;

b. expanding the primary key means to engage the sliding sleeve;

c. shifting the sliding sleeve to the equalizing detent position and simultaneously blocking the sliding sleeve from shifting to the fully open detent position;

d. retracting the primary key means from engagement with the sliding sleeve;

e. expanding the secondary key means to engage the sliding sleeve;

f. shifting the sliding sleeve to the fully open detent position; and g. thereafter retracting the secondary key means from engagement with the sliding sleeve.

16. The method of claim 15 wherein each recited step is performed in a single trip of the shifting tool into the well.

* * * * *